US005421886A

United States Patent [19]

Poole et al.

[11] Patent Number: 5,421,886

[45] Date of Patent: Jun. 6, 1995

[54] WALLPAPER PASTE APPLYING APPARATUS AND METHOD OF USE

[76] Inventors: Robert N. Poole, 110 E. Greenway Pkwy. #1105, Phoenix, Ariz. 85022; Daniel L. Poole, 11016 N. Biltmore #1216, Phoenix, Ariz. 85029

[21] Appl. No.: 78,347

[22] Filed: Jun. 21, 1993

[51] Int. Cl.[6] ..... B05C 3/18

[52] U.S. Cl. ..... 118/415; 118/419; 118/DIG. 17; 118/248; 118/263; 118/261

[58] Field of Search ..... 118/415, 419, DIG. 17, 118/428, 429, 258, 263, 244, 313, 325, 248, 247; 222/105, 541, 181, 611.2, 613; 156/524, 574, 575, 576, 577, 578

[56] References Cited

U.S. PATENT DOCUMENTS

| | | | |
|---|---|---|---|
| 1,265,127 | 5/1918 | Sleeper | 118/415 |
| 2,151,344 | 3/1939 | Barnard | 118/248 |
| 4,258,862 | 3/1981 | Thorsheim | 222/105 |
| 4,342,405 | 8/1982 | Croley | 222/105 |
| 4,449,646 | 5/1984 | Boners et al. | 222/105 |
| 4,660,502 | 4/1987 | Scott | 118/DIG. 17 |

*Primary Examiner*—Brenda Adele Lamb

*Attorney, Agent, or Firm*—Parsons & Associates; Don J. Flickinger; Robert A. Parsons

[57] ABSTRACT

A paste dispenser having a paste reservoir and an applicator for containing and applying paste to wallpaper. A package having a container and a base, transformable between a package configuration wherein the paste dispenser is received within the container and the container is closed by the base, and an applicator configuration wherein the base extends from the container and carries the paste dispenser. Arresting means in contact with the wallpaper for limiting the flow of paste from the paste dispenser.

46 Claims, 10 Drawing Sheets

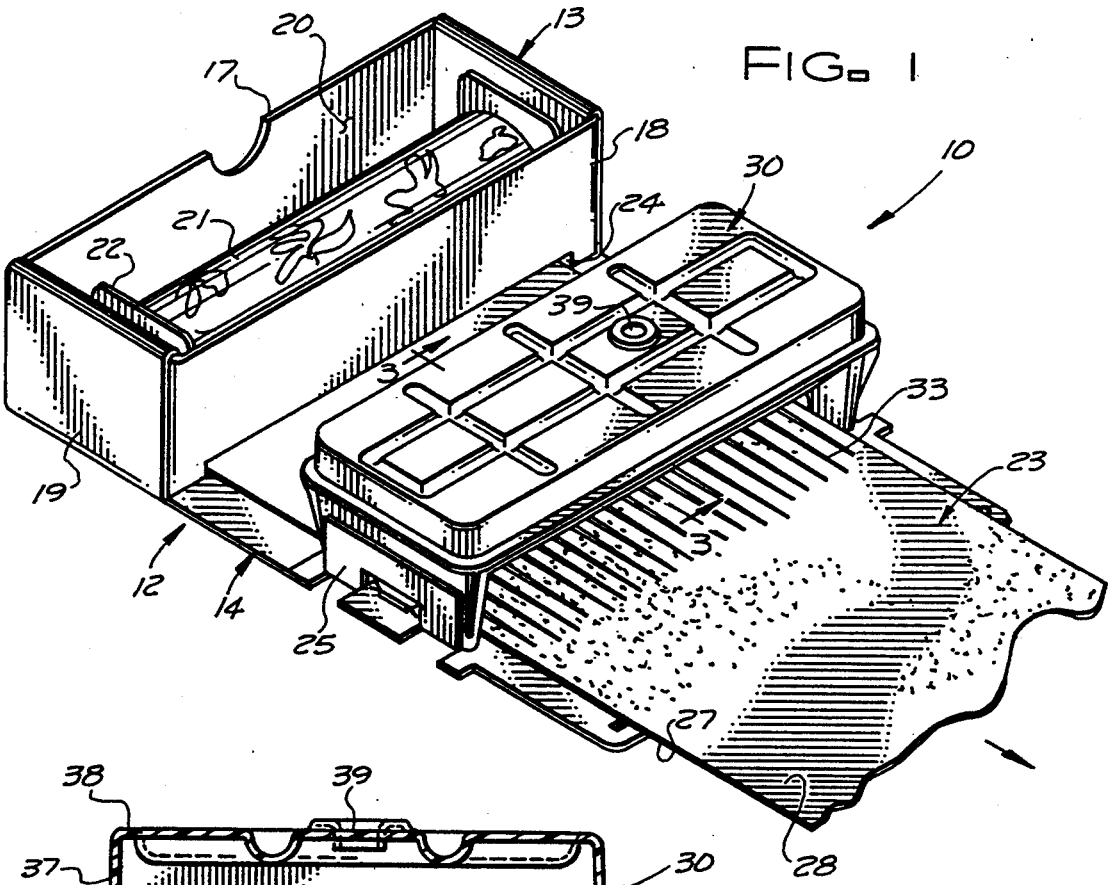
FIG. 1
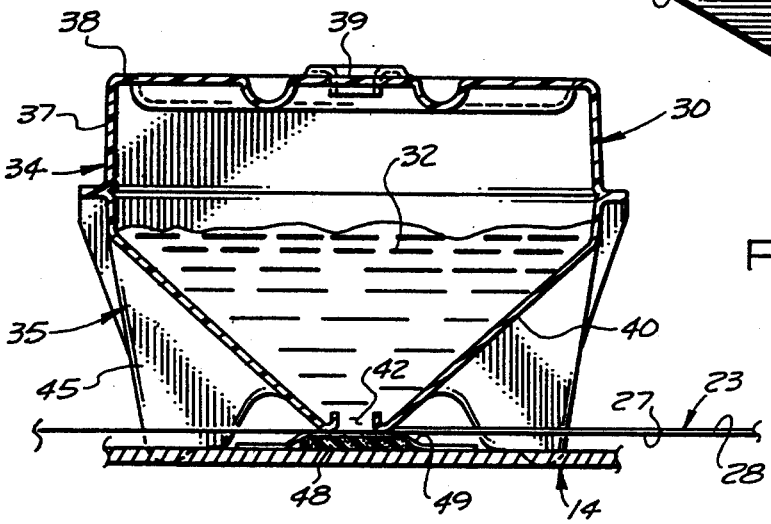
FIG. 3
FIG. 2
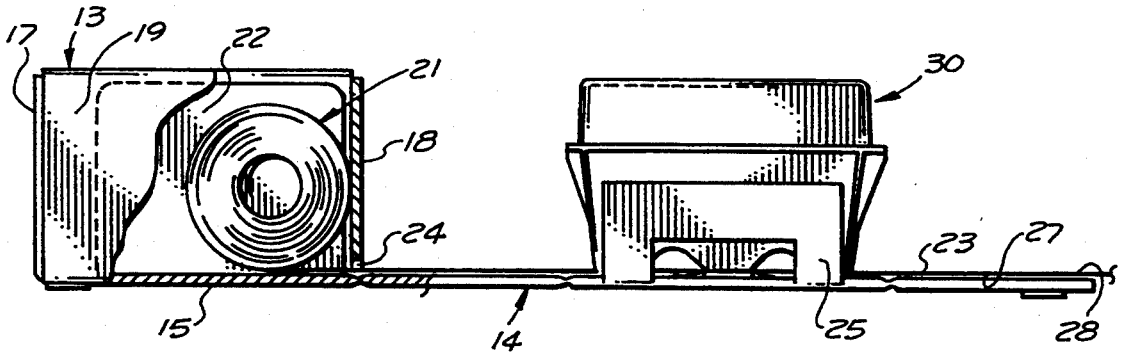

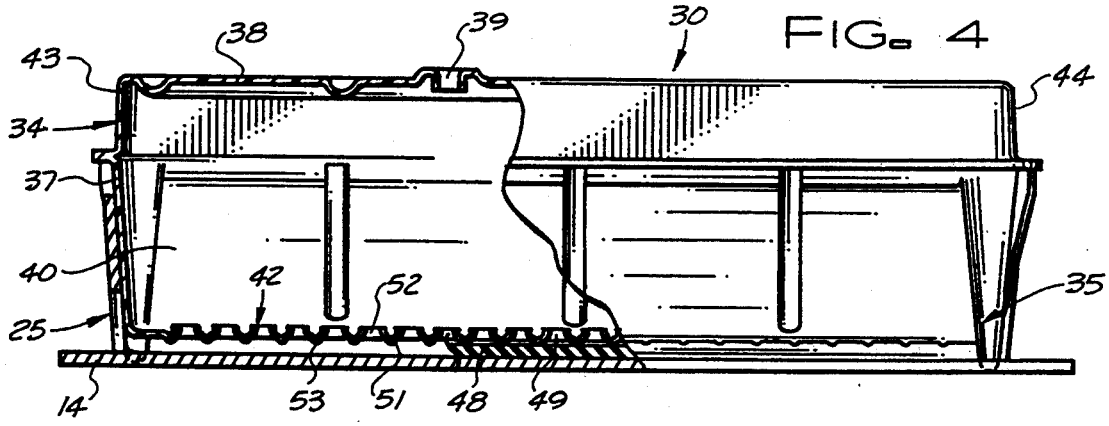
FIG. 4
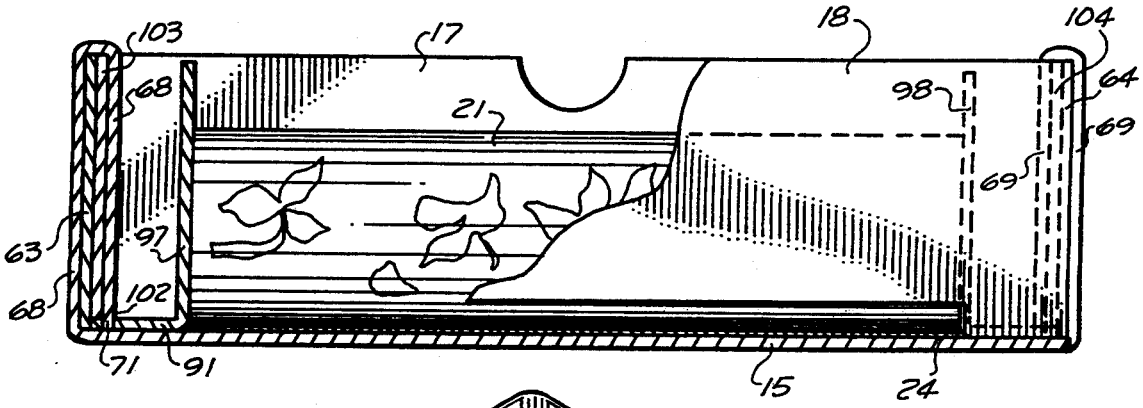
FIG. 8
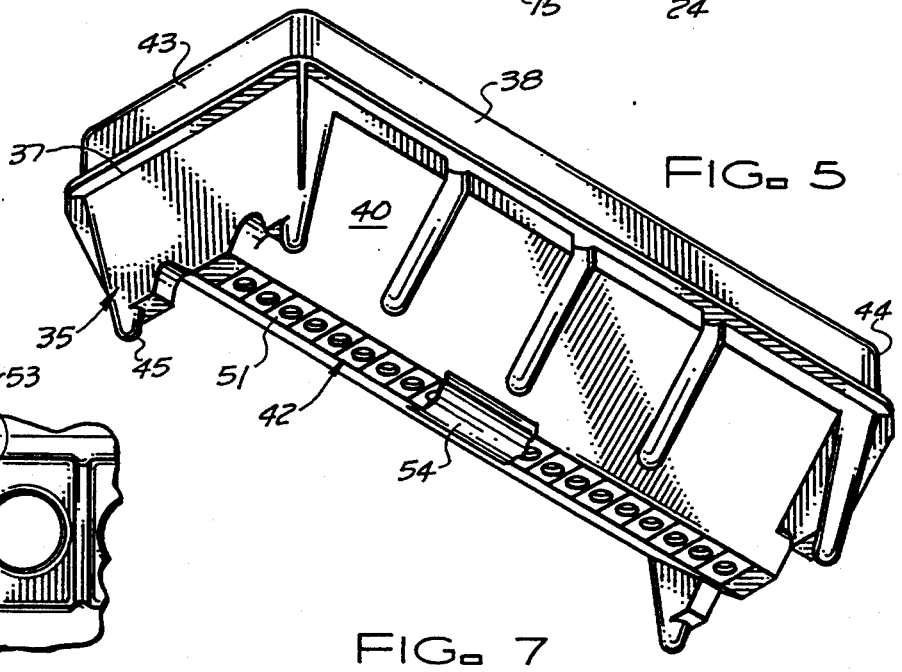
FIG. 5
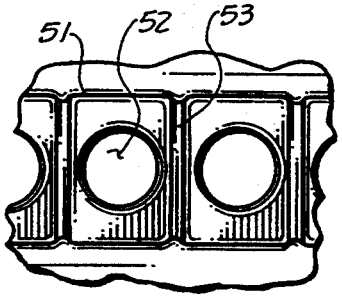
FIG. 6
FIG. 7
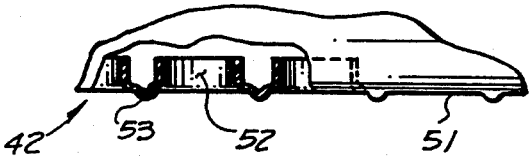

FIG. 9
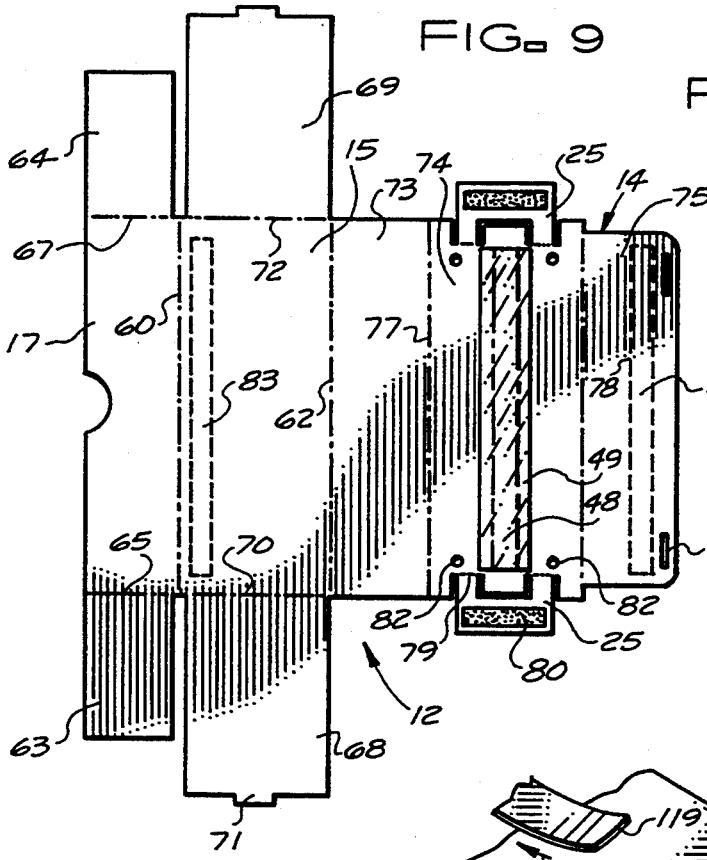
FIG. 10
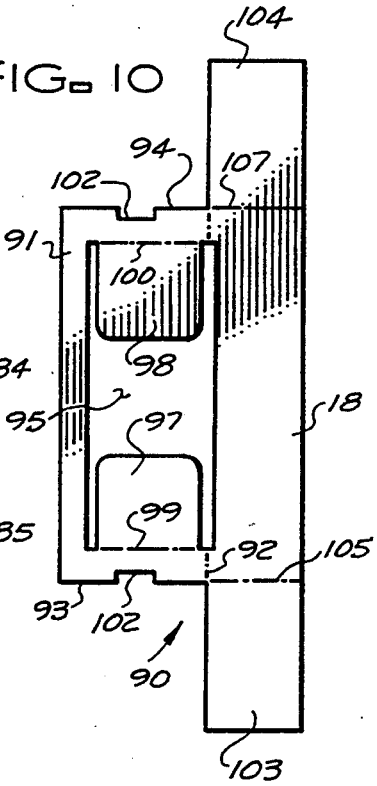
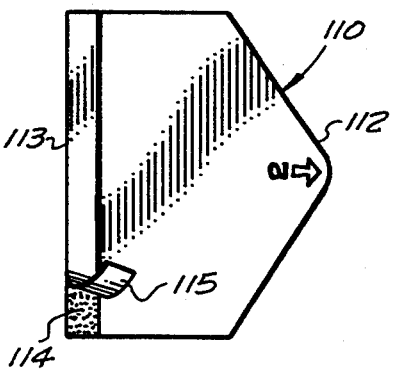
FIG. 11
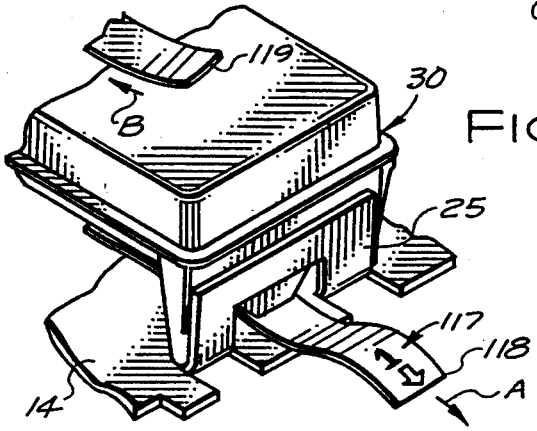
FIG. 12
FIG. 13
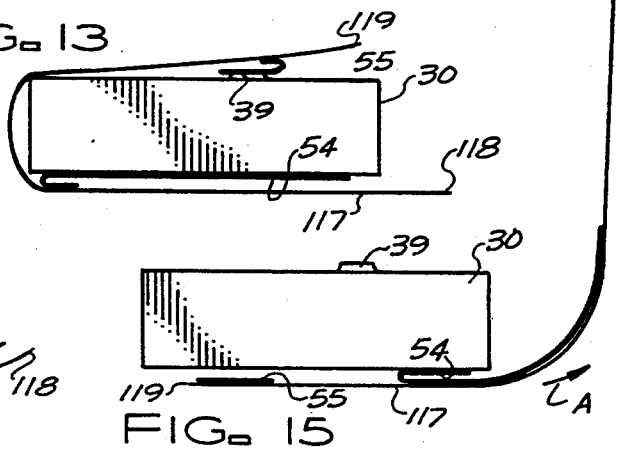
FIG. 14
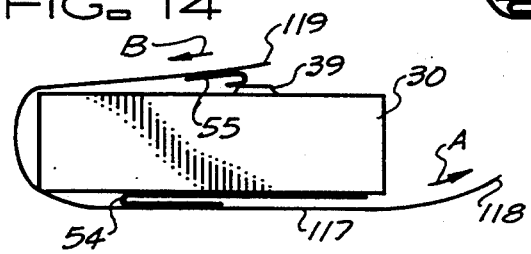
FIG. 15

13
30
120
C
73
14
74
25
83
D
122
10
A
118
117
119
39
55
113
110
112
75
23
90
21
123
198
F
97
E
115
24
114

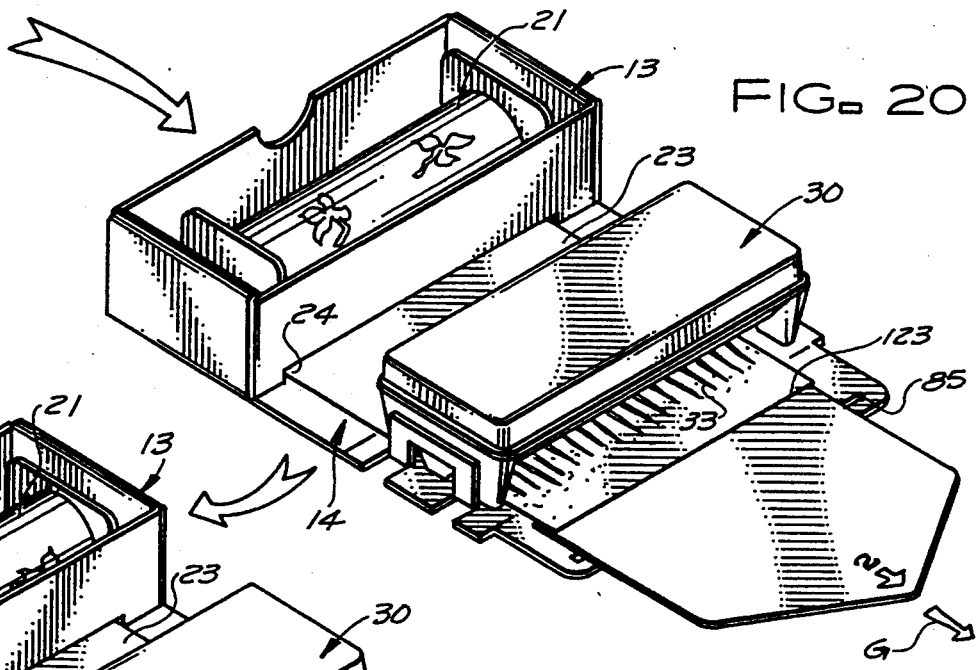
FIG. 20
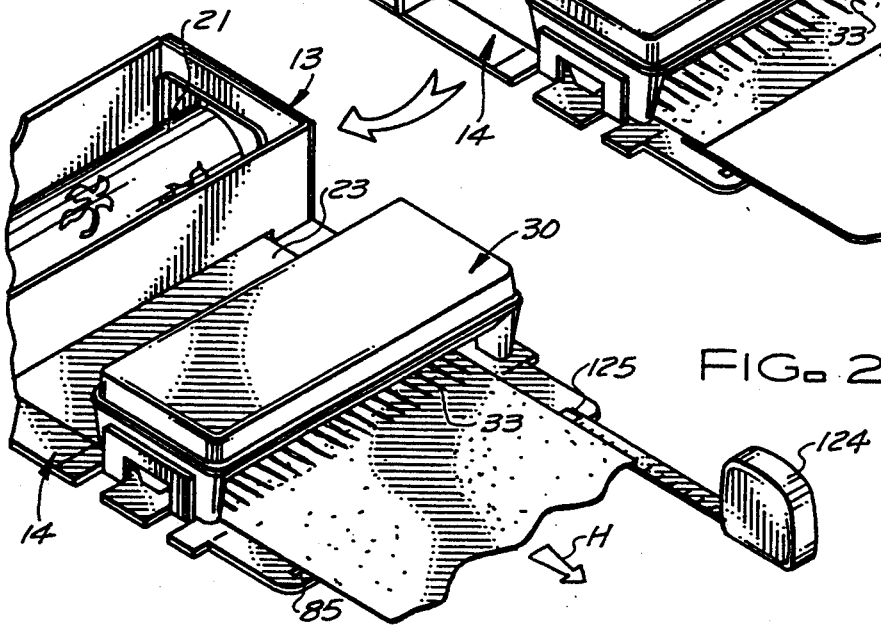
FIG. 21
FIG. 22
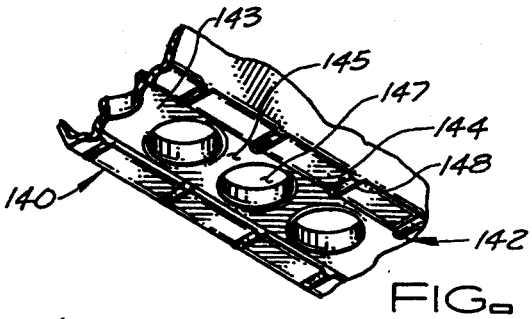
FIG. 24
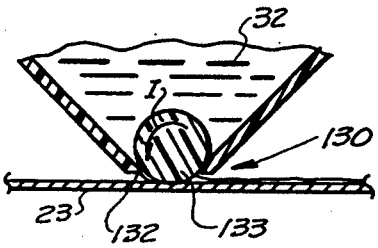
FIG. 23
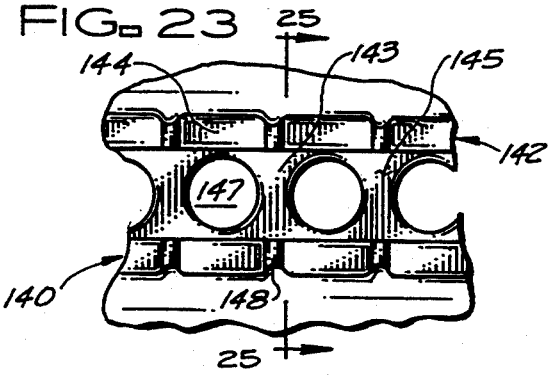
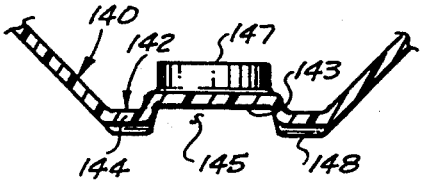
FIG. 25

FIG. 30
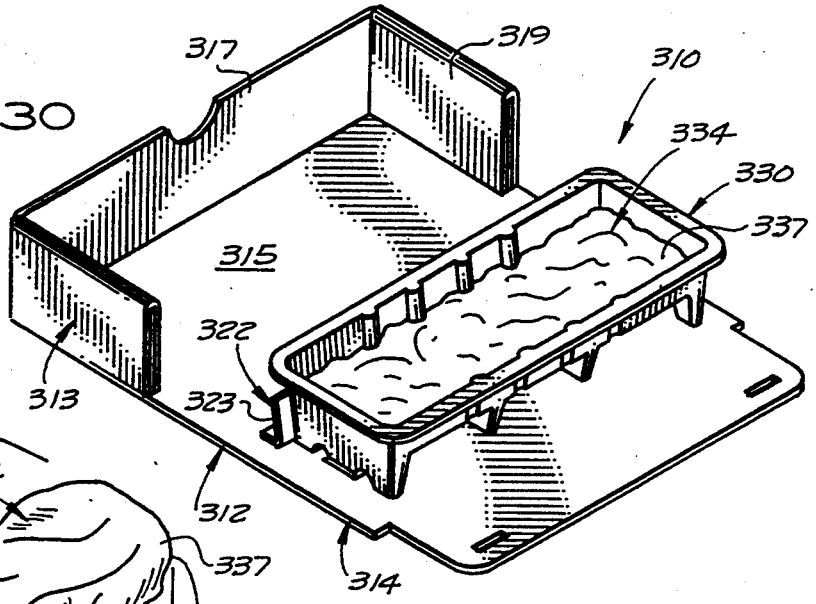
FIG. 31
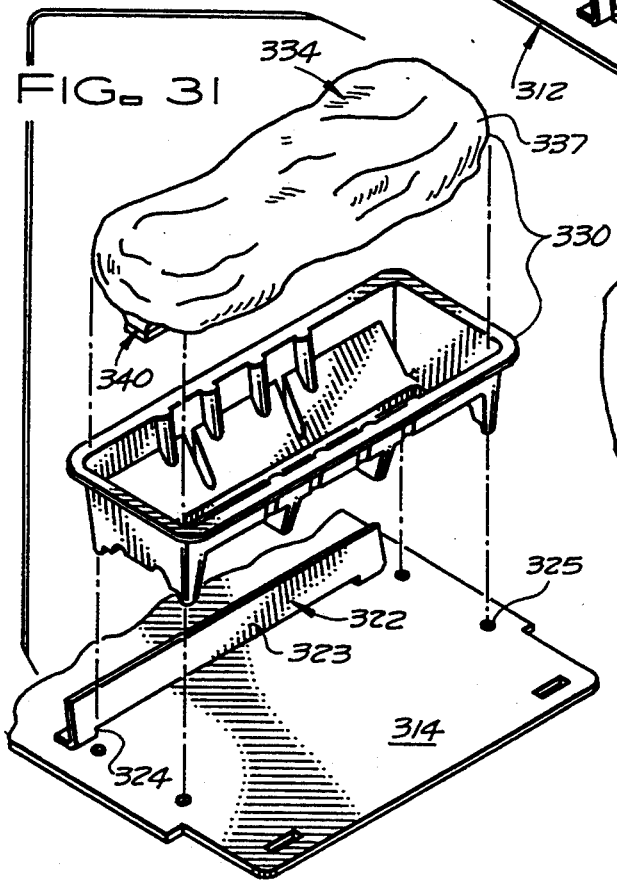
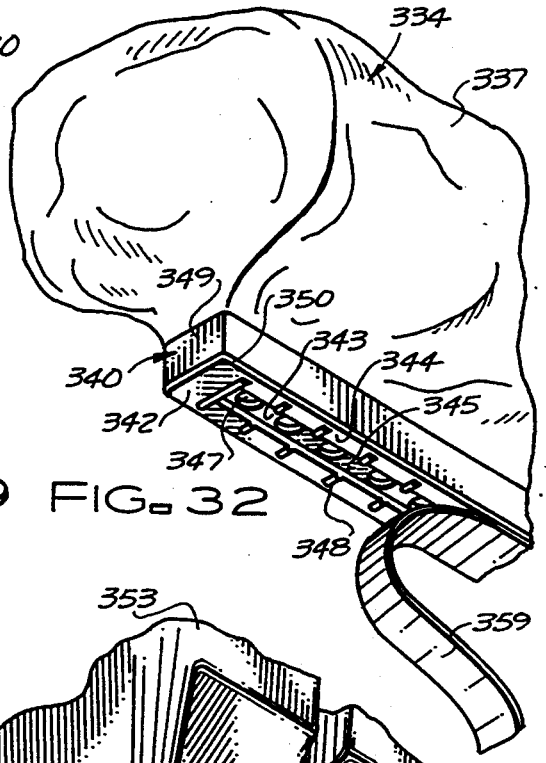
FIG. 32
FIG. 33
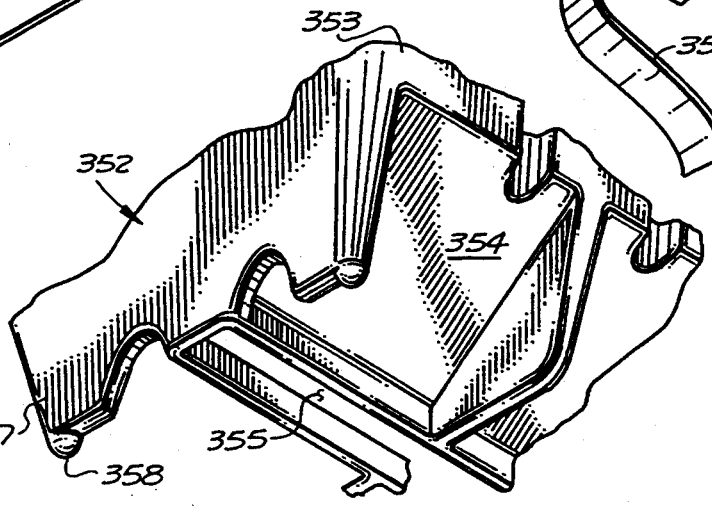

WALLPAPER PASTE APPLYING APPARATUS AND METHOD OF USE

BACKGROUND OF THE INVENTION

1. Field of the Invention

This invention relates to devices for aiding in hanging wallpaper.

More particularly, the present invention relates to devices for applying wallpaper paste to wallpaper.

In a further and more specific aspect, the present invention concerns a comprehensive wallpaper paste applying apparatus.

2. The Prior Art

Hanging paper on walls has long been practiced, and traditionally includes measuring and cutting a length of wallpaper from a roll, applying paste to the back surface of the length of wallpaper, and applying the paste coated side of the paper to a surface such as a wall or ceiling. Devices for aiding in applying wallpaper paste have been known for as long as wallpaper. A wide variety of devices are available, from brushes used to apply paste by hand and troughs through which lengths of paper are pulled, to large, complex and costly devices employed by professionals which are adjustable to apply a desired thickness of paste.

Each of the devices has benefits and detriments. The brushes, and troughs are very inexpensive and simple to use. However, while simple to use, they are not easy to use. Applying paste smoothly and evenly, to a desired thickness, requires a great deal of practice. Even with a great deal of experience, application of paste in this manner is inefficient, taking a relatively long time, with less than optimal results. These devices also tend to be messy, with paste spilled or otherwise distributed over surfaces that are not intended to be pasted, such as table tops or floor coverings. After use, the devices employed must be thoroughly cleaned, removing all traces of paste. If this is not done, the devices will be of little use in the future.

The more complex devices available, greatly increase efficiency, apply paste smoothly and evenly, and at adjustable depths. These same devices, however, also tend to be large, cumbersome, difficult to transport and expensive. These factors tend to limit the use of these devices to professional paper hangers, who can pay the additional costs by increasing their speed and efficiency. The private home owner simply cannot justify the expense of the large complex machines, since they paper only occasionally, and generally a very limited amount. Furthermore, the more complex devices require an expenditure of time to set up, and require cleaning when papering is finished.

It would be highly advantageous, therefore, to remedy the foregoing and other deficiencies inherent in the prior art.

Accordingly, it is an object of the present invention to provide improvements in applying wallpaper paste to wallpaper.

Another object of the present invention is to provide an improved wallpaper paste applying apparatus. And another object of the present invention is to provide a comprehensive wallpaper paste applying apparatus.

Still another object of the present invention is to provide a wall paper pasting apparatus which employs interchangeable paste cartridges.

Yet another object of the present invention is to provide an apparatus which is economical for use by the general public.

Yet still another object of the present invention is to provide a wallpaper paste applying apparatus which is light weight and portable.

A further object of the present invention is to provide a wallpaper paste applying apparatus which requires little setup and no clean-up.

And a further object of the present invention is to provide a wallpaper paste applying apparatus which is unencumbered, simple, and easy to use.

Yet a further object of the present invention is to provide an apparatus which applies a uniform coat of paste to wallpaper.

SUMMARY OF THE INVENTION

Briefly, to achieve the desired objects of the present invention in accordance with a preferred embodiment thereof, provided is a wallpaper paste applying apparatus for applying paste to wallpaper, including a paste dispenser and a package having a container, a paper retainer, and a base coupled to the container. The package is transformable between a package configuration and an applicator configuration. In the package configuration the paste dispenser is received within the container and the container is closed by the base. In the applicator configuration the base extends from the container and carries the paste dispenser. A roll of wallpaper is placed in the container with the paper extending between the paste dispenser and the base. Also provided is arresting means for limiting the flow of paste from the paste dispenser onto the paper.

In a further and more specific aspect, the paste dispenser includes a reservoir, an applicator, and a support. The reservoir supplies paste to the applicator, and is carried by the support.

In a specific embodiment, the applicator is coupled to the reservoir which is detachably received by the support. In this manner, the reservoir functions as a replaceable cartridge.

The above problems and others are overcome and the above objects are further realized in methods of using the wallpaper paste applying apparatus.

BRIEF DESCRIPTION OF THE DRAWINGS

The foregoing and further and more specific objects and advantages of the instant invention will become readily apparent to those skilled in the art from the following detailed description of a preferred embodiment thereof, taken in conjunction with the drawings, in which:

FIG. 1 is a perspective view of a wallpaper paste applying apparatus, constructed in accordance with the teachings of the present invention, as it would appear being used in the applicator configuration;

FIG. 2 is a side view illustrating the apparatus of FIG. 1;

FIG. 3 is a sectional view taken along line 3—3 of FIG. 1;

FIG. 4 is a partial sectional front view of a paste dispenser;

FIG. 5 is a perspective view of the paste dispenser illustrated in FIG. 4, with a fragment view of an applicator tab affixed to the applicator;

FIG. 6 is an enlarged fragmentary view of an applicator;

FIG. 7 is a sectional side view of a portion of the applicator illustrated in FIG. 6;

FIG. 8 is a front view of a container with a portion cut-away, as it would appear in the application configuration;

FIG. 9 is a top view of the container as it would appear disassembled;

FIG. 10 is a top view of the insert as it would appear disassembled;

FIG. 11 is a top view of a wallpaper guide;

FIG. 12 is a partial perspective view of seal means for sealing the paste dispenser;

FIG. 13–15 are schematic diagrams illustrating the removal of the vent tab and applicator tab of the paste dispenser in preparation for use;

FIG. 16 is a perspective view illustrating the wallpaper paste applying apparatus as it would appear in the packaged configuration;

FIG. 17 and 18 are perspective views illustrating the steps the steps the wallpaper paste applying apparatus undergoes as it is transformed from the packaged configuration to the application configuration;

FIG. 19–21 are perspective views illustrating the steps involved in inserting wallpaper into the wallpaper paste applying apparatus and applying paste;

FIG. 22 is an enlarged sectional side view of an alternate paste applicator;

FIG. 23 is an enlarged top view of an alternate paste applicator;

FIG. 24 is a partial perspective view of the applicator illustrated in FIG. 23;

FIG. 25 is a sectional view taken along line 25—25 of FIG. 23;

FIG. 30 is a perspective view of another embodiment of a wallpaper paste applying apparatus as it would appear being used in the applicator configuration;

FIG. 31 is an exploded view of the apparatus of FIG. 30;

FIG. 32 is a partial perspective view of the paste reservoir and applicator of FIG. 31;

FIG. 33 is a partial perspective view of the reservoir support of FIG. 31;

DETAILED DESCRIPTION OF THE PREFERRED EMBODIMENT

Figures 16, 17, 18, 19:
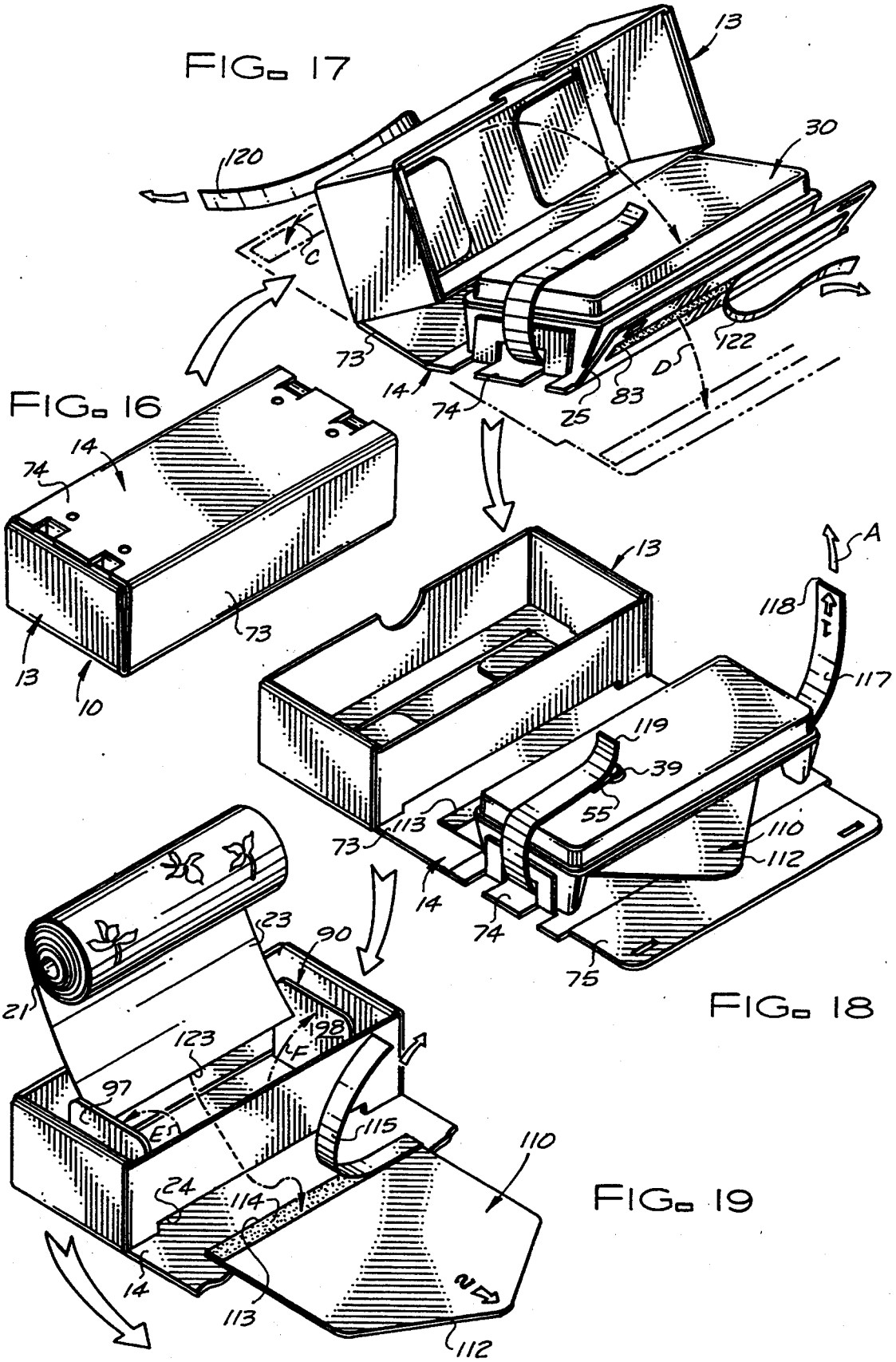

Turning now to the drawings in which like reference characters indicate corresponding elements throughout the several views, attention is first directed to FIG. 1 which illustrates a wallpaper paste applying apparatus generally designated by the reference character 10. Apparatus 10 includes a package 12 consisting of an open topped container 13 and a base 14. Package 12 is constructed so as to be deformable between a package configuration and an application configuration. In FIG. 1, package 12 is illustrated in the application configuration. The package configuration will be described in detail later in the description.

Container 13 has a bottom 15, not visible, a back wall 17, a front wall 18 and sidewalls 19, defining a cavity 20. A roll 21 of wallpaper 23 is positioned within cavity 20. Front wall 18 has a slot 24 formed therein, along the bottom edge adjacent bottom 15, through which lengths of wallpaper 23 are removed.

Base 14 extends forwardly from bottom 15, and includes a dispenser attachment 25 which positions and secures a paste dispenser 30. With additional reference to FIG. 2, wallpaper 23, having a front or patterned surface 27 and a back surface 28, is pulled from roll 21 positioned in cavity 20, through slot 24 with back surface 28 up, away from base 14. Bottom 15 supports roll 21 of paper 23, while front wall 18 holds roll 21 in a spaced apart relationship with paste dispenser 30. Paper 23 is fed between base 14 and paste dispenser 30 which uniformly deposits a coat of paste 32 in strips 33. The method of inserting wallpaper 23 and applying paste will be described below.

Turning now to FIG. 3, paste dispenser 30 includes a paste reservoir 34 carried by a support 35. Paste reservoir 34, in this embodiment, includes opposing walls 37, a top 38 with a vent opening 39 and a downward sloping bottom 40 terminating in a longitudinally extending outlet centrally positioned between walls 37. An applicator 42 is coupled to paste reservoir 34 at the outlet, and extends between ends 43 and 44 of paste reservoir 34 as seen in FIGS. 4 and 5, and has a length which corresponds to the width of paper 23. Support 35, in this embodiment, includes legs 45 which depend downward from sloping bottom 40 proximate ends 43 and 44, supporting reservoir 34 with applicator 42 spaced apart from base 14.

Arresting means for limiting the flow of paste 32, which in this embodiment includes a resilient member 48 and a anti-friction layer 49, is coupled to base 14 in a position which corresponds to applicator 42 when paste dispenser 30 is properly positioned by dispenser attachment 25. Resilient member 48 is formed from a resilient material such as foam rubber. Anti-friction layer 49 is preferably a thin layer of slippery material such as plastic, which is coupled over resilient member 48. Paper 23 passes between the arresting means and applicator 42, and is biased firmly against applicator 42 by resilient member 48 so as to prevent paste 32 from leaking out over back surface 28 of paper 23. Anti-friction layer 49 helps paper 23 slide freely under paste dispenser 30 for a smooth, uniform coat of paste.

In this embodiment, applicator 42 of paste dispenser 30 is a substantially horizontal panel 51 through which a plurality of apertures 52 extend, as can be seen in FIG. 4 with additional reference to FIGS. 6 and 7. Apertures 52 are evenly spaced, extending between ends 43 and 44. Each aperture 52 is separated from adjacent apertures 52 by parallel spacer ridges 53. Paste 32 flows freely through apertures 52 onto back surface 28 as paper 23 is moved between paste dispenser 30 and base 14. Spacer ridges 53 extend outward from panel 51, forming boundaries for paste flowing from each aperture 52. Paste strips 33 are formed by applying separate flows of paste from each aperture 52 to paper 23. Each of apertures 52 supplies a flow of paste kept separate from adjacent flows by spacer ridges 53.

It can be seen that the arresting means, consisting a resilient member 48 and anti-friction layer 49, firmly presses paper 23 against spacer ridges 53. Those skilled in the art will understand that resilient member 48 may be substantially any means for biasing wallpaper 23 against applicator 42. This biasing action prevents leakage of paste 32 between ridges 53 and prevents the application of an excess of paste 32. As the paste level goes down within reservoir 34, vent opening 39 allows entry of air into reservoir 34 preventing the formation of a vacuum which would disrupt the even flow of paste through apertures 52.

Turning now to FIG. 5, paste dispenser 30 is sealed by sealing means, which in this embodiment consists of an outlet tab 54, and a vent tab 55. Outlet tab 54 is a strip of material affixed to sloping bottom 40 by an adhesive, sealing apertures 52 and preventing paste 32 from exiting reservoir 34. Vent opening 39 is sealed in a similar manner by vent tab 55, not specifically illustrated in FIG. 5. A detailed description of the removal of the sealing means will be provided below.

Turning now to FIG. 9, a portion of package 12 is shown as it would appear disassembled. Back wall 17, bottom 15 and base 14 are formed from a generally rectangular sheet of formable material such as cardboard or plastic. Back wall 17 is foldable upward, substantially perpendicular to bottom 15 along a fold line 60. Base 14 is foldable upward, substantially perpendicular to bottom 15 along a fold line 62. A pair of tabs 63 and 64 extend laterally outward from back wall 17 and are foldable substantially perpendicular to back wall 17 along fold lines 65 and 67 respectively. A pair of sections 68 and 69 extend laterally outward from bottom 15 and are foldable substantially perpendicular to bottom 15 along fold lines 70 and 72 respectively. A tab 71 extends outward from each of sections 68 and 69, whose purpose will be disclosed later in the disclosure. Base 14 is divided into three portions, front potion 73, cover portion 74 and flap portion 75, by parallel fold lines 77 and 78 extending laterally across base 14, substantially parallel to fold line 62.

Still referring to FIG. 9, resilient member 48 and anti-friction layer 49 are coupled to cover portion 74. Dispenser attachments 25 extend laterally outward from cover portion 74 and are foldable substantially perpendicular to cover portion 74 along fold lines 79. Adhesive strips 80 are placed on the inner surface of dispenser attachments 25, positioned so as to adhere to dispenser 30, positioning it properly over resilient member 48. Openings 82, formed in cover portion 74, receive legs 45, further positioning and retaining paste dispenser 30. Paste applying apparatus 10 may be fastened to a substrate by fastening means which consists of adhesive strips 83 and 84 attached to the outer surfaces of bottom 15 and flap portion 75 respectively. Adhesive strips 83 and 84 may be used to adhere paste applying apparatus 10 to a suitable surface such as a table or counter top, to prevent movement thereof when extracting wallpaper 23. Slots 85 are formed through flap portion 75 proximate opposing edges thereof. The use of the slots will be described in detail below.

A paper retainer 90 completes package 12, and is illustrated in FIG. 10. Paper retainer 90 includes a section 91 and front wall 18 as a single sheet of material, separated by a fold line 92. Section 91 is generally rectangular and has opposing edges 93 and 94. Front wall 18 is foldable substantially perpendicular to section 91 along fold line 92. An opening 95 is formed in section 91, spaced from edges 93 and 94 and overlapping fold line 92. The portion of opening 95 along fold line 92 is slot 24 when formed into container 13. A pair of ears 97 and 98 extend laterally inward into opening 95 from section 91 proximate edges 93 and 94 respectively and are foldable perpendicularly upward along fold lines 99 and 100 respectively, to be used to position and retain roll 21 of wallpaper 23. A notch 102 is formed in each edge 93 and 94 and a pair of tabs 103 and 104 extend laterally outward from front wall 18, foldable substantially perpendicular to front wall 18 along fold lines 105 and 107 respectively.

Sidewalls 19 of container 13 are formed by the interaction of tabs 63 and 64, sections 68 and 69 with tabs 71, notches 102, and tabs 103 and 104 as illustrated in FIG. 8. Back wall 17 is folded upward along fold line 60 (not shown). Tabs 63 and 64 are folded inward along fold lines 65 and 67 perpendicular to back wall 17 and extending along fold lines 70 and 72. Paper retainer 90 is positioned so that section 91 rests on bottom 15 with edges 93 and 94 abutting tabs 63 and 64. Front wall 18 is folded upward along fold line 92 (not shown), upright with respect to section 91. Tabs 103 and 104 are folded inward along fold lines 105 and 107 perpendicular to front wall 18 and extending along fold lines 70 and 72 to the inside of tabs 63 and 64. Sections 68 and 69 are folded upward along fold lines 70 and 72 upright with respect to bottom 15, bent over tabs 63, 103 and 64, 104 respectively, and folded downward along tabs 103 and 104 respectively, with tabs 71 each inserted into slots 102 securely holding sidewalls 19 together.

FIG. 11 illustrates a wallpaper guide generally designated 110. Wallpaper guide 110 is a stiff sheet of material such as cardboard or plastic, having a leading edge 112 and a trailing edge 113. Wallpaper guide 110 is preferably of a chevron shape, with the pointed side being leading edge 112. Trailing edge 113 is coated with an adhesive 114 covered by a protective strip 115. The use of wallpaper guide 110 will be discussed below.

Referring now to FIG. 12, a pull tab 117 having a first end 118 and a second end 119 is shown. Pull tab 117 encircles paste dispenser 30, starting with second end 119 coupled to an end of vent tab 55, continuing around end 43 of paste dispenser 30 and coupling to an end of outlet tab 54, with first end 118 projecting out from between paste dispenser 30 and base 14. First end 118 of pull tab 117 is pulled in an outward direction indicated by arrowed line A, away from paste applying apparatus 10, and second end 119 moves in the opposite direction indicated by arrowed line B.

FIGS. 13–15 illustrate the removal of vent tab 55 and outlet tab 54. As first end 118 of pull tab 117 is pulled in the direction of arrowed line A, outlet tab 54 is peeled from applicator 42. At the same time, second end 119 moves in the opposite direction indicated by arrowed line B. As second end 119 moves across top 38 of paste dispenser 30, vent tab 55 is peeled off of vent opening 39 as illustrated in FIG. 14. As pull tab 117 is extracted from between base 14 and paste dispenser 30, vent tab 55 and outlet tab 54 are completely removed from vent opening 39 and applicator 42 respectively, initiating flow of paste onto wallpaper 23 as illustrated in FIG. 15.

Turning now to FIG. 16, wallpaper paste applying apparatus 10 is illustrated in the package configuration. In this configuration, paste dispenser 30 (not visible) is carried within container 13 with base 14 used as a cover. Front portion 73 is folded upward, parallel to and received against front wall 18. Cover portion 74, with paste dispenser 30 positioned and secured thereon, extends over the open top of container 13 effectively closing it, and positioning paste dispenser 30 within cavity 20. Flap portion 75 extends downward, parallel to and received against back wall 17. Flap portion 75 may be received against the outside of back wall 17 and secured in place in any conventional manner, but is preferable received against the inside, inserted between back wall 17 and paste dispenser 30.

Wallpaper paste applying apparatus 10 is transformed to the applicator configuration as shown in FIGS. 17–20. Base 14 is folded outward, removing paste dispenser 30 from container 13. Protective strips 120 and 122, covering adhesive strips 83 and 84 respectively, are removed. Container 13 and base 14 are moved in the directions indicated by arrowed lines C and D respectively. By firmly pressing uncovered adhesive strips 83 and 84 to a substrate, such as a table or counter, wallpaper paste applying apparatus 10 is securely held in place.

Once wallpaper paste applying apparatus 10 is securely held in place, wallpaper guide 110 is inserted between base 14 and dispenser 30, as illustrated in FIG. 18, with leading edge 112 projecting forward of paste dispenser 30 and trailing edge 113 projecting rearward of paste dispenser 30. At this point, outlet tab 54 and vent tab 55 are removed by pulling pull tab 117 as described above. With vent opening 39 and applicator 42 unsealed, application of paste may commence.

Referring now to FIG. 19, paper retainer 90 is readied to receive roll 21 of wallpaper 23 by folding ears 97 and 98 upward in a direction indicated by arrowed lines E and F respectively. Roll 21 is positioned between ears 97 and 98 with a leading edge 123 of wallpaper 23 passing out of container 13 through slot 24. Protective strip 115 is removed from adhesive 114 of wallpaper guide 110. Leading edge 123 of wallpaper 23 is affixed to wallpaper guide 110 by uncovered adhesive 114. In FIG. 19 one skilled in the art will understand that guide 110 is in the position illustrated in FIG. 18, but for purposes of illustration is seen without paste dispenser 30 since it would block the view of adhesive 114.

Referring to FIG. 20, wallpaper 23 is pulled into position between base 14 and paste dispenser 30 by moving wallpaper guide 110 forward, in the direction indicated by arrowed line G. At this point, wallpaper 23 is in position for paste application.

Turning now to FIG. 21, paste is applied to wallpaper 23 by moving wallpaper 23 between base 14 and paste dispenser 30 in a forward direction as indicated by arrowed line H. A measuring device, such as a conventional tape measure 124, may be used to measure wallpaper 23 as it is extracted from wallpaper paste applying apparatus 10. A hooked end 125 of conventional tape measure 124 is received in one of slots 85 allowing the tape to be extended, thereby providing a temporary measuring device for use in combination with wallpaper paste applying apparatus 10 to facilitate obtaining a desired length of pasted wallpaper.

Turning now to FIG. 22, an alternate embodiment 130 of a paste applicator is illustrated. In this embodiment paste applicator 130 consists of an outlet 132 formed in sloping bottom 40 and a roller 133 received within outlet 132. Flow of paste through outlet 132 is regulated by roller 133 which is rotated in a direction indicated by arcuate arrowed line I. The rotation of roller 133 results from the passage of wallpaper 23. As roller 133 rotates, paste 32 is applied to wallpaper 23 in a uniform coat. In this embodiment, paste strips 33 are not formed.

A further embodiment 140 of a paste applicator is illustrated in FIGS. 23–25. Applicator 140 is formed in sloping bottom 40 of reservoir 34, and includes a substantially horizontal panel 142 having an inset portion 143 bordered by raised portions 144. A channel 145 is formed between raised portions 144. Apertures 147 extend through panel 142 spaced apart along inset portion 143. Paste flows through apertures 147 an collects in channel 145. Spacer ridges 148 extend outward from raised portions 144 transverse to channel 145, forming boundaries for paste 32 being applied to paper 23 from channel 145. Spacer ridges 148 cause paste to be deposited in strips as described above.

Figure 26:
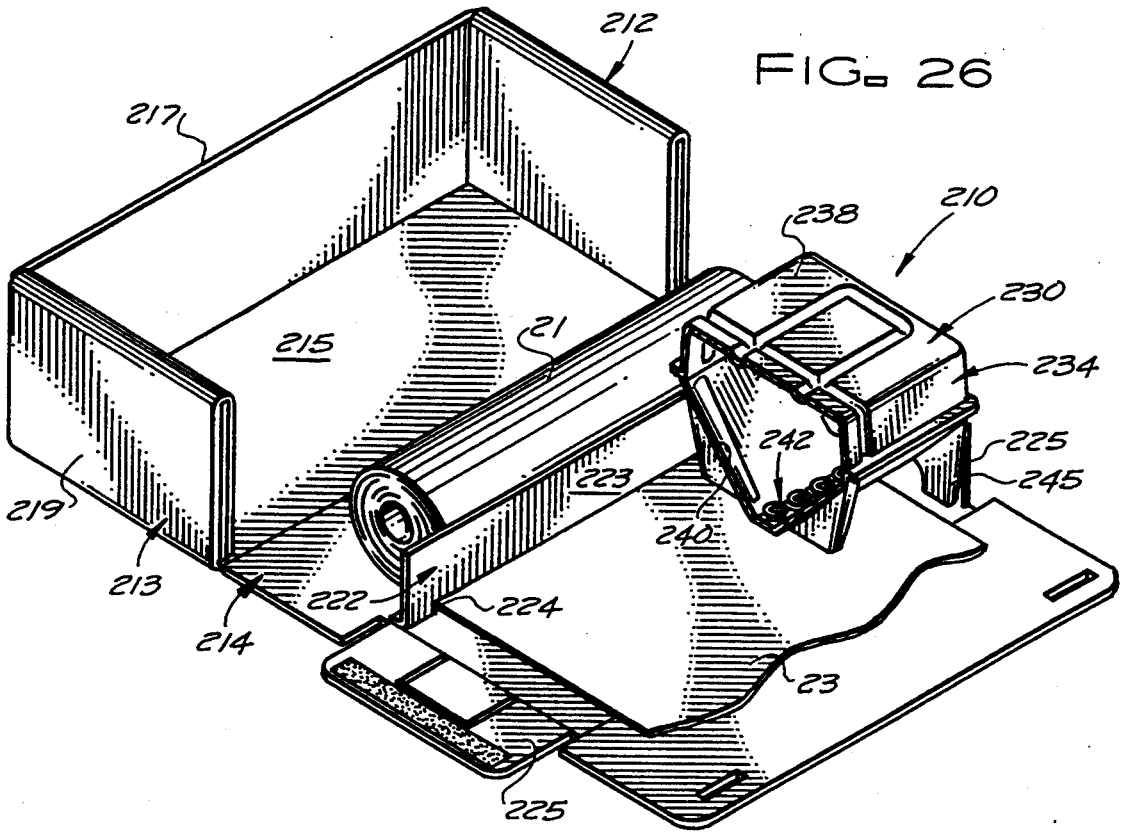
FIG. 26 is a perspective view of another embodiment of a wallpaper paste applying apparatus as it would appear being used in the applicator configuration.

Referring now to FIG. 26, a further embodiment 210 of a paste applying apparatus, substantially identical to apparatus 10, is shown. Apparatus 210 includes a package 212 consisting of an open topped container 213 and a base 214. Package 212 is constructed so as to be deformable between a package configuration and an application configuration. Container 213 has a bottom 215, a back wall 217, and sidewalls 219. Base 214 extends forwardly from bottom 215, and includes dispenser attachments 225 which position and secure a paste dispenser 250.

Figure 27:
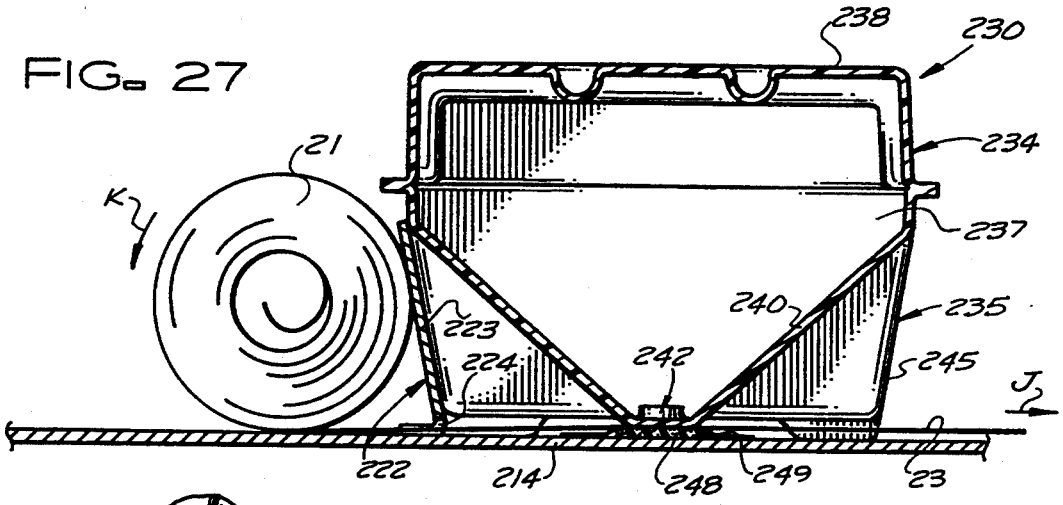
FIG. 27 is a sectional side view of the apparatus of FIG. 26.

With additional reference to FIG. 27, paste dispenser 230 includes a paste reservoir 234 carried by a support 235. Paste reservoir 234, in this embodiment, includes opposing walls 237, a top 238, and a downward sloping bottom 240 terminating in a longitudinally extending applicator 242 centrally positioned between walls 237. Support 235, in this embodiment, includes legs 245 which depend downward from sloping bottom 240 proximate opposing ends of dispenser 230, supporting reservoir 234 so that applicator 242 is spaced apart from base 214. Apparatus 210 also includes arresting means, substantially identical to that described above for apparatus 10. Arresting means includes a resilient member 248 and an anti-friction layer 249, coupled to base 214 in a position which corresponds to applicator 242 when paste dispenser 230 is properly positioned by dispenser attachment 225. Resilient member 248 biases paper 23 against applicator 242 preventing free outflow of paste without a corresponding movement of paper 23.

Apparatus 210 differs from apparatus 10 in that paper retainer 90 of apparatus 10 is replaced with a paper retainer 222. Paper retainer 222 consists of a wall 223 affixed to base 214 proximate paste dispenser 230 on the rearward side, towards container 213. Wall 223 abuts paste dispenser 230, as can be seen in FIG. 27, and has a slot 224 proximate base 214 through which paper 23 can be extracted. Paper 23 is extracted from roll 21, between applicator 242 and the arresting means, in a direction indicated by arrowed line J. As paper 23 is extracted, roll 21 rotates in a direction indicated by arrowed line K and is prevented from being pulled under and disrupting paste dispenser 230 by wall 223. It will be understood that wallpaper 23 may be inserted between base 214 and paste dispenser 230 by using the paper guide described in detail above. Furthermore, apparatus 210 is converted between a package configuration and an applicator configuration in a manner identical to apparatus 10 described above. In all other respects, apparatus 210 is substantially identical to apparatus 10.

Figure 28:
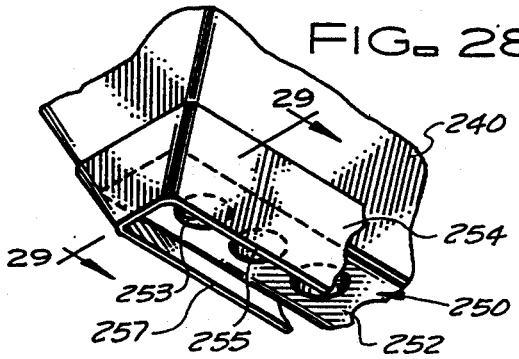
FIG. 28 is an enlarged partial perspective view of an embodiment of a paste applicator.

While applicator 242 of wallpaper paste applying apparatus 210 is substantially identical to applicator 42 described above in conjunction with apparatus 10, a further embodiment of an applicator designated 250 may be employed. It will be understood that applicator 250 may be used in any of the proceeding embodiments of a paste applying apparatus, or any yet to be described, but will be described as replacing applicator 242 in FIGS. 28 and 29. Referring to FIG. 28, applicator 250 is formed in sloping bottom 240 of reservoir 234. Applicator 250 includes a substantially horizontal panel 252 through which a plurality of apertures 53 extend. Applicator 250 differs from applicator 42 in that it does not have spacer ridges, and has arresting means coupled thereto, replacing resilient member 248 and anti-friction layer 249. In this embodiment arresting means is a collar 254 having a leading edge 255 and a trailing edge 257, coupled to sloping bottom 240, encircling applicator 250. Collar 254 encircles applicator 250 and is constructed of a flexible material such that leading edge 255 and a trailing edge 257 firmly contact wallpaper 23.

Figure 29:
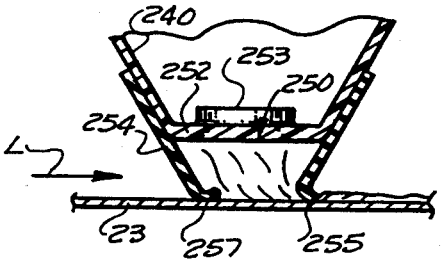
FIG. 29 is a sectional side view of the applicator of FIG. 28.

Referring to FIG. 29, it can be seen that the flexible nature of leading edge 255 and trailing edge 257 permits paper 23 to pass under paste dispenser 230 in the direction indicated by arrowed line L, with leading edge 255 uniformly distributing paste flowing from applicator 250. The contact between wallpaper 23 and collar 254 prevents free outflow of paste without a corresponding movement of paper 23.

A further embodiment 310 of a paste applying apparatus is shown in FIG. 30. Apparatus 310 includes a package 312 consisting of an open topped container 313 and a base 314. Package 312 is constructed so as to be deformable between a package configuration and an application configuration. Container 313 has a bottom 315, a back wall 317, and sidewalls 319 constructed in a manner generally identical to container 13 as illustrated in FIG. 9. Base 314 extends forwardly from bottom 315, and includes openings 325 which position and secure a paste dispenser 330. Apparatus 310 differs from apparatus 10 in that paper retainer 90 of apparatus 10 is replaced with a paper retainer 322. Paper retainer 322 consists of a wall 323 affixed to base 314 proximate paste dispenser 330 on the rearward side, towards container 313. Wall 323 abuts paste dispenser 330, as can be seen in FIG. 30, and has a slot 324 proximate base 314 through which paper 23 can be extracted.

With additional reference to FIG. 31 and 32, paste dispenser 330 includes a paste reservoir 334 carried by a support 335. Paste reservoir 334, in this embodiment, includes a collapsible bag 337 having an edge 338 (not visible) defining an outlet 339 (not visible), and an applicator 340 coupled thereto. Applicator 340 consists of a substantially horizontal panel 342 having an inset portion 343 bordered by raised portions 344. A channel 345 is formed between raised portions 344. Apertures 347 extend through panel 342 spaced apart along inset portion 343. Paste flows through apertures 347 an collects in channel 345. Spacer ridges 348 extend outward from raised portions 344 transverse to channel 345, forming boundaries for paste 32 being applied to paper 23 from channel 345. An upright wall 349 extends from panel 342, set back from edges thereof, leaving slight protrusions 350. Wall 349 receives edge 338 of bag 337 providing an outlet for paste contained therein.

With additional reference to FIG. 33, support 352 includes opposing walls 353, and a downward sloping bottom 354 terminating in a longitudinally extending opening 355 centrally positioned between walls 353. Opening 355 is configured to receive applicator 340. Legs 357 depend downward from sloping bottom 354 proximate opposing ends, supporting reservoir 334 so that applicator 340 is spaced apart from base 314. Projections 358, extending downward from legs 357, are received within openings 339, positioning and retaining paste dispenser 330 on base 314.

Figure 34:
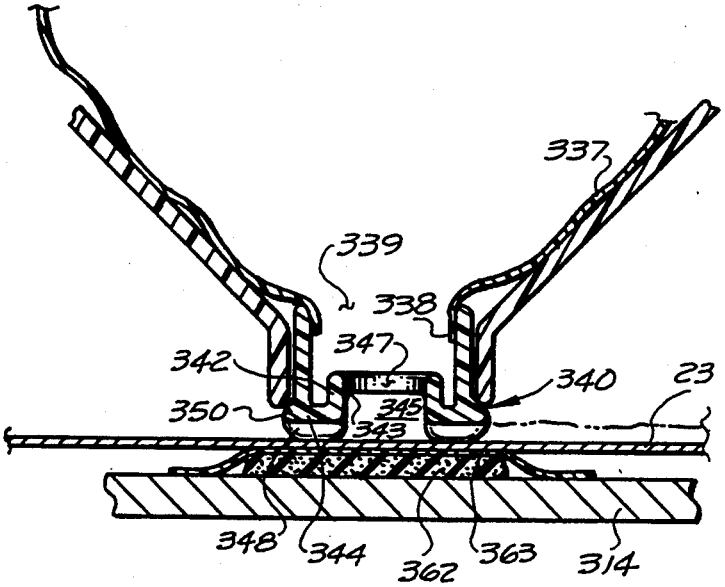
FIG. 34 is a partial sectional side view of the paste dispenser of FIG. 30.

Applicator 340 is received through opening 355 secured by protrusions 350 as can be seen in FIG. 34, with bag 337 resting upon sloping bottom 354. Referring specifically to FIG. 32, flow of paste 32 is begun by removing an outlet tab 359 sealing applicator 340. Tab 359 may be removed in a manner similar to that discussed above in conjunction with FIGS. 12–15.

Apparatus 310 also includes arresting means, illustrated in FIG. 34, substantially identical to that described above for apparatus 10. Arresting means includes a resilient member 362 and an anti-friction layer 363, coupled to base 314 in a position which corresponds to applicator 340 when paste dispenser 330 is properly positioned by openings 325. Resilient member 362 biases paper 23 against applicator 340 preventing free outflow of paste 32 without a corresponding movement of paper 23.

Figure 35:
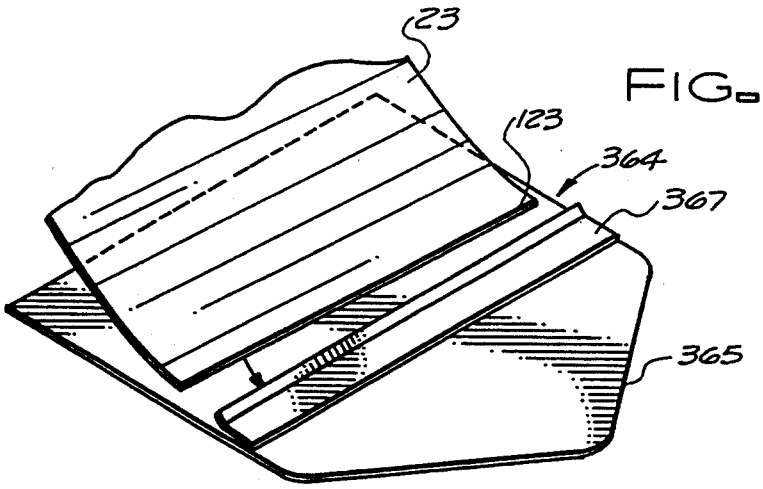
FIG. 35 is a perspective view of an embodiment of a wallpaper guide.
Figure 36:
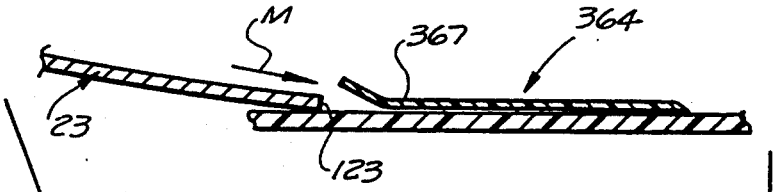
FIG. 36 is a sectional side view of the wallpaper guide of FIG. 35.

FIGS. 35 and 36 illustrate a further embodiment of a wallpaper guide generally designated 364. Wallpaper guide 364 is a stiff sheet of material such as cardboard or plastic, having a leading edge 365 and a trailing edge 366. Wallpaper guide 364 is preferably of a chevron shape, with the pointed side being leading edge 365. A wallpaper clip 367 is affixed to wallpaper guide 364 intermediated leading edge 365 and trailing edge 366. Wallpaper clip 367 receives and retains leading edge 123 when wallpaper 23 is inserted in a direction indicated by arrowed line M. The method of using wallpaper guide 364 is substantially identical to the method described above for wallpaper guide 110.

Figure 37:
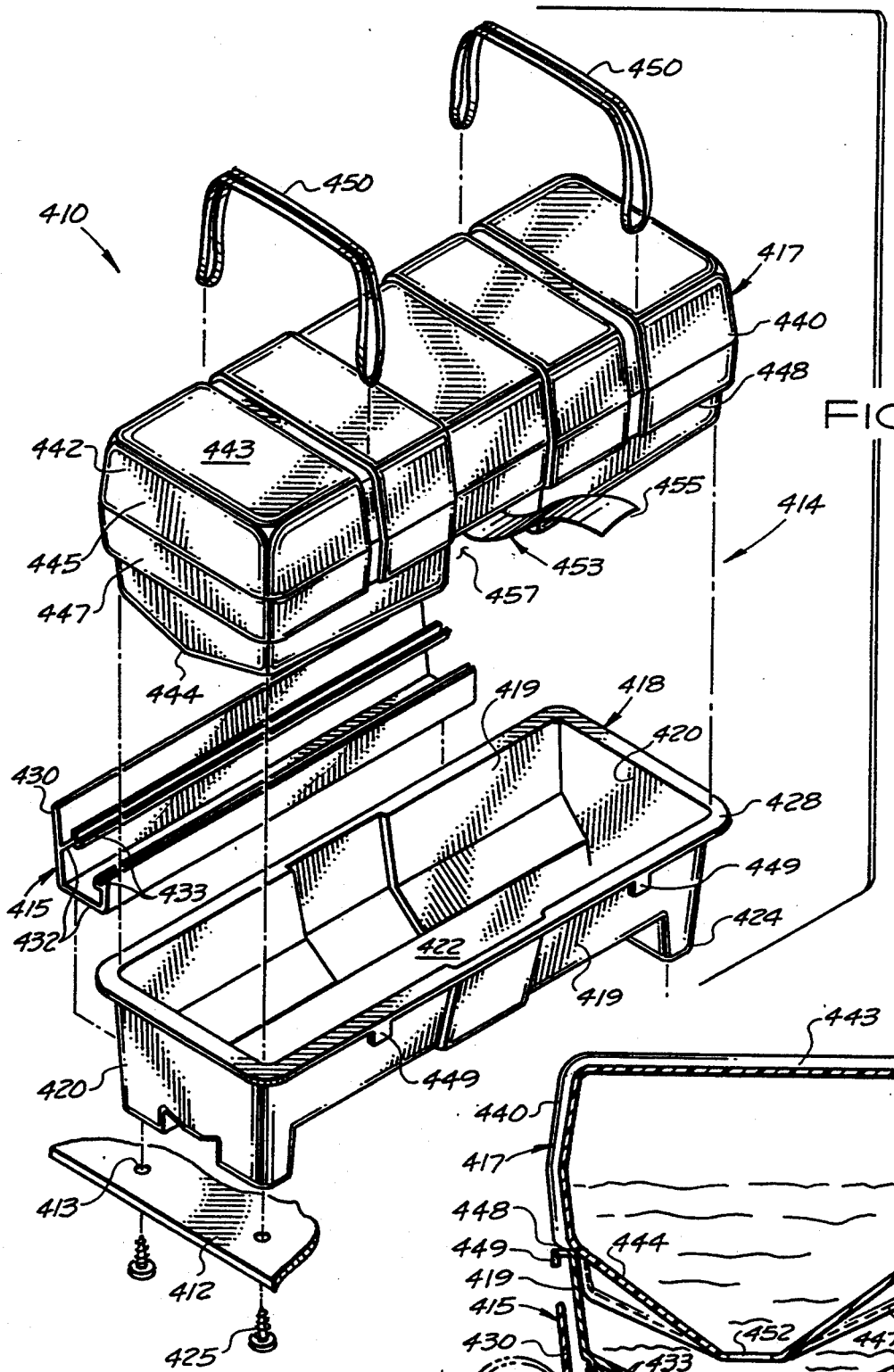
FIG. 37 is an exploded view of a further embodiment of a wallpaper paste applying apparatus.

A further embodiment 410 of a paste applying apparatus is shown in FIG. 37. Apparatus 410 includes a package (not shown) which may be substantially identical to any of the previously described packages. The package includes a base 412 having openings 413 which position and secure a paste dispenser 414. Apparatus 410 includes a paper retainer 415 which is attachable to paste dispenser 414. Paper retainer 415 will be discussed in greater detail below.

Figure 38:
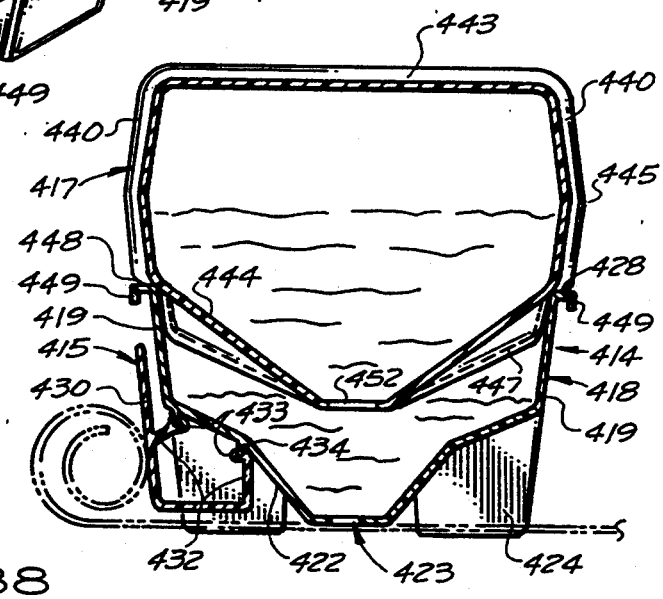
FIG. 38 is a sectional end view of the wallpaper paste applying apparatus of FIG. 37.
Figure 39:
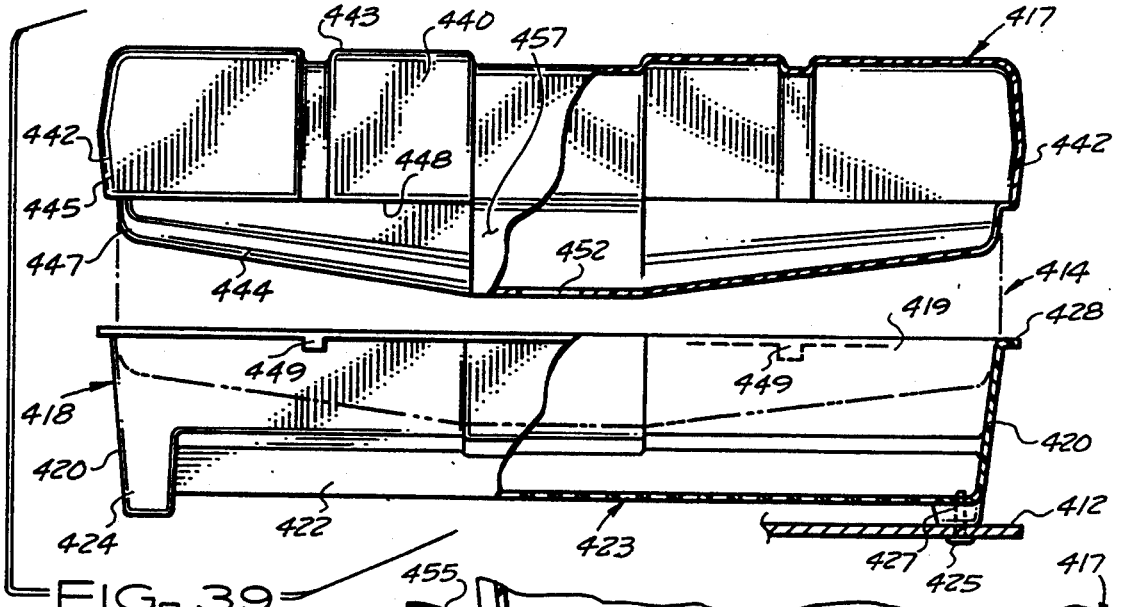
FIG. 39 is a partial sectional front view of the wallpaper paste applying apparatus of FIGS. 37 and 38.
Figure 40:
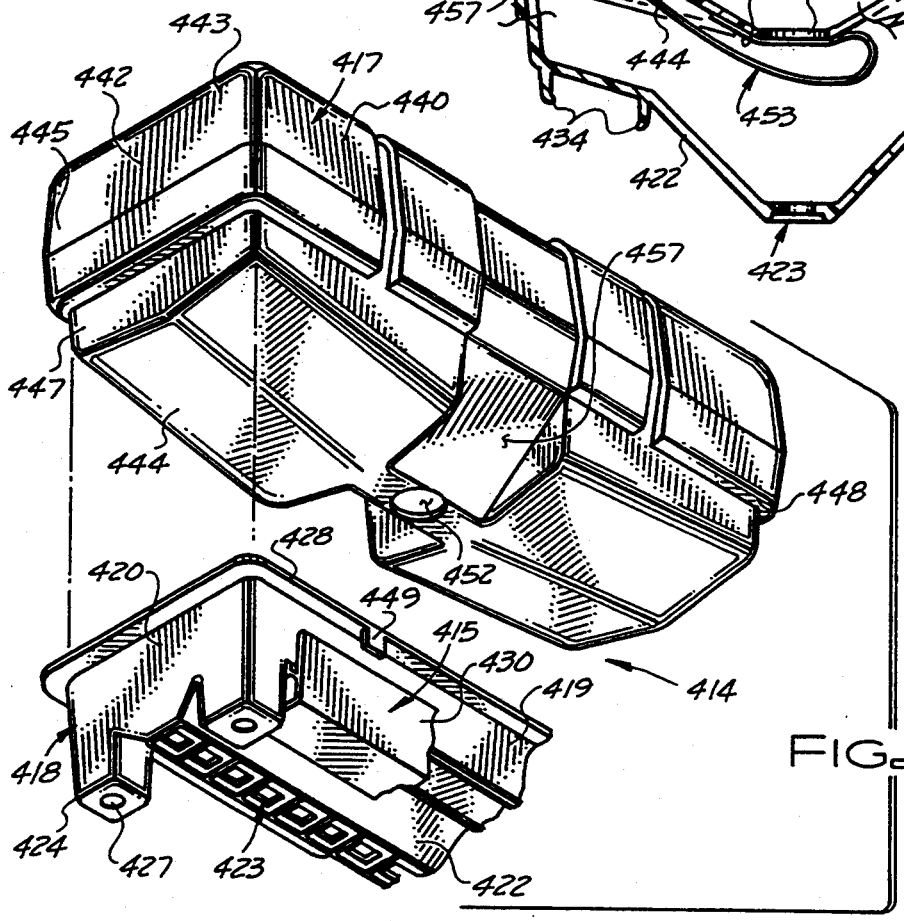
FIG. 40 is a partial perspective view of the paste dispenser of FIG. 38, with the reservoir separated from the support.

With additional reference to FIG. 38, paste dispenser 414 includes a paste reservoir 417 carried by a support 418. Support 418 includes opposing walls 419, opposing end walls 420 and a downward sloping bottom 422 terminating in a longitudinally extending applicator 423 centrally positioned between walls 419. Applicator 423 extends between end walls 420 of support 418 as seen in FIGS. 39 and 40, and has a length which generally corresponds to the width of the wallpaper being use. Applicator 423 may be any of the previously described embodiments. Legs 424 depend downward from sloping bottom 422 proximate opposing end walls 420, supporting support 418 so that applicator 423 is spaced apart from base 412. Screws 425, extending upward through openings 413 in base 412, are received within openings 427 (visible in FIG. 40) formed in each of legs 424, positioning and retaining paste dispenser 414 on base 412. An outwardly directed lip 428 extends from the top edge of opposing walls 419 and end walls 420 for supporting paste reservoir 417.

Paper retainer 415, in this embodiment is an upright member 430 which is removably coupled to support 418. Upright member 430 is preferable coupled to support 418 with a snap fit arrangement consisting of complemental male and female elements. Upright member 430 has extensions 432 terminating in female elements 433 while male elements 434 are formed on bottom 422 of support 418 extending the length of opposing walls 419. It will be understood that male elements 434 may extend along bottom 422 proximate either or both of opposing walls 419. As can be seen in FIG. 38, upright member 430 prevents the roll of wall paper from being pulled under paste dispenser 414 when paste is being applied.

Still referring to FIGS. 37 and 38, paste reservoir 417, in this specific embodiment, includes opposing walls 440, end walls 442, a top 443, and a downward sloping bottom 444. Paste reservoir 417 is divided into an upper portion 445 and a lower portion 447 by an outward flaring of opposing walls 440 and end walls 442, forming a substantially horizontal overhang 448 encircling reservoir 417 generally intermediate bottom 444 and top 443. In this specific embodiment, paste reservoir 417 is configured to function as a replaceable cartridge removably inserted into support 418. Lower portion 447 is received by support 418, with overhang 448 engaging lip 428. Securement means is also provided for securing reservoir 417 to support 418. The preferred securement means consists of pairs of opposing hooks 449, one of each pair being visible in FIG. 37, depending downward from lip 428 at opposing walls 419 proximate end walls 420. An elastic member 450 extends between hooks 449 of each pair, extending over top 443 of reservoir 417, firmly pressing overhang 448 against lip 428.

When installed in support 418, bottom 444 of reservoir 417 is suspended above bottom 422 of support 418. Paste is discharged from reservoir 417 and is collected in support 418. The slope of bottom 422 directs paste to applicator 423. Bottom 444 of reservoir 417 slopes downward from opposing walls 440 to a point intermediate opposing walls 440 as can be seen with specific reference to FIG. 38. Bottom 444 also slopes downward from end walls 442 to an intermediate point therebetween, as can be seen with specific reference to FIG. 39. FIG. 40 clearly shows bottom 444, sloping downward from opposing walls 440, and end walls 442 to a centrally located outlet 452 intermediate opposing walls 440 and end walls 442. The sloping configuration of bottom 444 compels substantially all of the paste contained in paste reservoir 417 to discharge through outlet 452 into support 418. As can be seen with reference back to FIG. 38, paste collecting in support 418 has been found to rise to a level which generally reaches outlet 452. At this point, discharge of paste from reservoir 417 is halted until the level is lowered. When the supply of paste has been exhausted in one reservoir or a different type of paste is desired, the reservoir can be removed and replaced with a full reservoir, or a reservoir containing a different paste.

Figure 41:
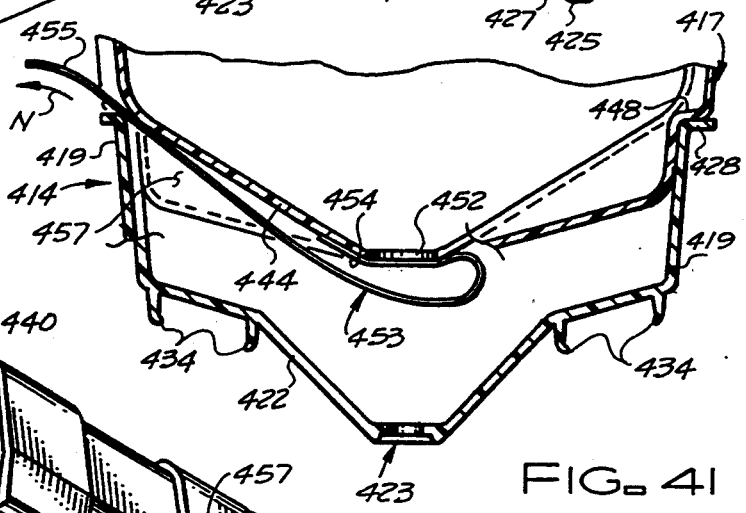
FIG. 41 is a sectional end view of the paste dispenser of FIG. 38.

With reference to FIG. 41, paste reservoir 417 is sealed by a pull tab 453 having a seal end 454 which is removably affixed to bottom 444 around the periphery of outlet 452, and an opposing tab end 455. Pull tab 453 seals outlet 452, allowing reservoir 417 to be moved and handled individually, without discharge of paste. This permits reservoir 417 to be used as a cartridge which may be replaced as desired.

Installation of reservoir 417 is accomplished by placing a sealed reservoir 417 onto support 418 so that lower portion 447 is received within support 418 and overhang 448 engages lip 428. Pull tab 453 is doubled back upon itself, with tab end 455 extending from between bottom 444 of reservoir 417 and lip 428 of support 418. A space between bottom 444 and lip 428 sufficient for the egress of tab end 455 is provided by a sloped channel 457 formed in reservoir 417. Channel 457 substantially girdles reservoir 417, extending centrally down opposing walls 440 through overhang 448, and continuing through bottom 444 to a point adjacent outlet 452. This is most clearly visible in FIG. 40. Elastic members 450 are then placed over reservoir 417, coupled between opposing hooks 449 of each pair. Reservoir 417 is then unsealed by gripping tab end 455 of pull tab 453 and extracting in a direction indicated by arrowed line N. Paste is then free to discharge through outlet 452 into support 418.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A wallpaper paste applying apparatus for applying paste to wallpaper, said apparatus comprising:
- a paste dispenser including
  - an applicator for applying paste to said wallpaper,
  - a paste reservoir having an outlet formed therein, for containing said paste, and
  - a support attachable to a base, for supporting said paste reservoir;
- a package including a container and said base coupled to said container, said package transformable between a package configuration wherein said paste dispenser is received within said container and said container is closed by said base, and an applicator configuration wherein said base extends away from said container and carries said paste dispenser; and
- arresting means for limiting a flow of paste from said paste dispenser.

2. A wallpaper paste applying apparatus as claimed in claim 1 wherein said applicator includes a panel with a plurality of apertures extending therethrough, coupled to said reservoir at said outlet.

3. A wallpaper paste applying apparatus as claimed in claim 2 wherein said applicator further includes a plurality of spacer ridges extending from said panel, between said plurality of apertures.

4. A wallpaper paste applying apparatus as claimed in claim 2 wherein said applicator further includes an inset portion formed in said panel through which said apertures extend, defining a channel in which said paste collects for application to said wallpaper.

5. A wallpaper paste applying apparatus as claimed in claim 1 wherein said applicator includes a roller rotatably carried within said outlet.

6. A wallpaper paste applying apparatus as claimed in claim 1 wherein said paste reservoir is detachably received by said support.

7. A wallpaper paste applying apparatus as claimed in claim 6 wherein said paste reservoir further includes a collapsible bag having an edge defining said outlet, to which said applicator is coupled.

8. A wallpaper paste applying apparatus as claimed in claim 7 wherein said support includes:

a sloping bottom, configured to receive and support said bag;

a longitudinally extending opening formed in said sloping bottom and configured to receive said applicator; and legs extending from said sloping bottom, supporting said applicator above said base.

9. A wallpaper paste applying apparatus as claimed in claim 8 wherein said applicator includes:

a panel with an edge;

a plurality of apertures extending through said panel;

an upright wall extending from said panel coupled to said edge of said bag; and securing means for securing said applicator within said opening.

10. A wallpaper paste applying apparatus as claimed in claim 6 wherein said support further includes:

a sloping bottom terminating in said applicator;

walls extending from said sloping bottom;

legs extending from said sloping bottom, supporting said applicator above said base; and securement means for securing said reservoir to said support.

11. A wallpaper paste applying apparatus as claimed in claim 10 wherein said securement means includes:

a plurality of hooks extending downwardly from an outer surface of said walls; and an elastic member extendable between said hooks for engagement with said reservoir.

12. A wallpaper paste applying apparatus as claimed in claim 10 wherein said applicator includes a panel with a plurality of apertures extending therethrough.

13. A wallpaper paste applying apparatus as claimed in claim 12 wherein said applicator further includes a plurality of spacer ridges extending from said panel, between said plurality of apertures.

14. A wallpaper paste applying apparatus as claimed in claim 12 wherein said applicator further includes an inset portion formed in said panel through which said apertures extend, defining a channel in which said paste collects for application to said wallpaper.

15. A wallpaper paste applying apparatus as claimed in claim 10 wherein said paste dispenser further includes sealing means for sealing said paste reservoir.

16. A wallpaper paste applying apparatus as claimed in claim 1 wherein said paste reservoir includes:

a sloping bottom terminating in said applicator;

walls extending from said sloping bottom;

a top coupled to said walls; and a vent hole formed in said top.

17. A wallpaper paste applying apparatus as claimed in claim 16 wherein said support includes legs extending from said sloping bottom, supporting said applicator above said base.

18. A wallpaper paste applying apparatus as claimed in claim 1 wherein said arresting means includes a resilient member coupled to said base proximate said applicator, for biasing said wallpaper against said applicator and an anti-friction layer overlaying said resilient member.

19. A wallpaper paste applying apparatus as claimed in claim 1 wherein said arresting means includes a collar coupled to said paste dispenser, encircling said applicator, said collar having a flexible leading edge and a flexible trailing edge.

20. A wallpaper paste applying apparatus as claimed in claim 1 further including fastening means for fastening said container and said base to a substrate.

21. A wallpaper paste applying apparatus for applying paste to wallpaper, said apparatus comprising:

a paste dispenser having an applicator for applying paste to said wallpaper;

a package including a container, a paper retainer, and a base coupled to said container, said package transformable between a package configuration wherein said paste dispenser is received within said container and said container is closed by said base, and an applicator configuration wherein said base extends away from said container and carries said paste dispenser; and arresting means for limiting a flow of paste from said paste dispenser.

22. A wallpaper paste applying apparatus as claimed in claim 21 wherein said base includes attachment means for retaining and positioning said paste dispenser.

23. A wallpaper paste applying apparatus as claimed in claim 22 wherein said container includes:

a bottom;

a back wall; and sidewalls.

24. A wallpaper paste applying apparatus as claimed in claim 23 wherein said paper retainer includes a planar section overlaying said bottom, carrying foldable ears and a front wall, said front wall having a slot formed therein adjacent said section and providing a front wall to said container.

25. A wallpaper paste applying apparatus as claimed in claim 22 wherein said paper retainer includes an upright wall coupled to said base, adjacent said paste dispenser, and a slot formed in said wall proximate said base.

26. A wallpaper paste applying apparatus as claimed in claim 22 wherein said paper retainer includes an upright member coupled to said paste dispenser, spaced apart from said base.

27. A wallpaper paste applying apparatus as claimed in claim 22 wherein said package further includes fastening means for fastening said container and said base to a substrate.

28. A wallpaper paste applying apparatus as claimed in claim 22 wherein said paste dispenser further includes:

a paste reservoir having an outlet formed therein, for containing said paste; and a support attachable to said base, for supporting said paste reservoir.

29. A wallpaper paste applying apparatus as claimed in claim 28 wherein said paste reservoir is detachably received by said support.

30. A wallpaper paste applying apparatus as claimed in claim 29 wherein said paste reservoir further includes a collapsible bag having an edge defining said outlet, to which said applicator is coupled.

31. A wallpaper paste applying apparatus as claimed in claim 30 wherein said support includes:

a sloping bottom, configured to receive and support said bag;

a longitudinally extending opening formed in said sloping bottom and configured to receive said applicator; and legs extending from said sloping bottom, supporting said applicator above said base.

32. A wallpaper paste applying apparatus as claimed in claim 31 wherein said applicator includes:

a panel with an edge;

a plurality of apertures extending through said panel;

an upright wall extending from said panel coupled to said edge of said bag; and securing means for securing said applicator within said opening.

33. A wallpaper paste applying apparatus as claimed in claim 29 wherein said support further includes:

a sloping bottom terminating in said applicator;

walls extending from said sloping bottom;

legs extending from said sloping bottom, supporting said applicator above said base; and securement means for securing said reservoir to said support.

34. A wallpaper paste applying apparatus as claimed in claim 33 wherein said securement means includes:

a plurality of hooks extending downwardly from an outer surface of said walls; and an elastic member extendable between said hooks for engagement with said reservoir.

35. A wallpaper paste applying apparatus as claimed in claim 33 wherein said applicator includes a panel with a plurality of apertures extending therethrough.

36. A wallpaper paste applying apparatus as claimed in claim 35 wherein said applicator further includes a plurality of spacer ridges extending from said panel, between said plurality of apertures.

37. A wallpaper paste applying apparatus as claimed in claim 28 wherein said paste reservoir further includes:

a sloping bottom terminating in said outlet;

walls extending from said sloping bottom;

a top coupled to said walls; and a vent hole formed in said top.

38. A wallpaper paste applying apparatus as claimed in claim 37 wherein said support includes legs extending from said sloping bottom, supporting said outlet above said base.

39. A wallpaper paste applying apparatus as claimed in claim 38 wherein said applicator includes a panel with a plurality of apertures extending therethrough coupled to said reservoir at said outlet.

40. A wallpaper paste applying apparatus as claimed in claim 39 wherein said applicator further includes a plurality of spacer ridges extending from said panel, between said plurality of apertures.

41. A wallpaper paste applying apparatus as claimed in claim 39 wherein said applicator further includes an inset portion formed in said panel through which said apertures extend, defining a channel in which said paste collects for application to said wallpaper.

42. A wallpaper paste applying apparatus as claimed in claim 38 wherein said applicator includes a roller rotatably carried within said outlet.

43. A wallpaper paste applying apparatus as claimed in claim 28 wherein said arresting means includes a resilient member coupled to said base proximate said applicator, for biasing said wallpaper against said applicator and an anti-friction layer overlaying said resilient member.

44. A wallpaper paste applying apparatus as claimed in claim 28 wherein said arresting means includes a collar coupled to said paste dispenser, encircling said applicator, said collar having a flexible leading edge and a flexible trailing edge.

45. A cartridge for use with a wallpaper paste applying apparatus including a support having a sloping bottom terminating in an applicator for applying paste to wallpaper, and securement means for securing said cartridge to said support;

said cartridge comprising:

a reservoir for containing the paste, said reservoir having an outlet and a bottom sloping downward to said outlet, said reservoir removably receivable by said support such that said support suspends said outlet above said bottom of said support, said reservoir further includes opposing ends;

a removable pull tab coupled to said reservoir around a periphery of said outlet for sealing said reservoir; and a channel substantially girdling said reservoir intermediate said opposing ends, permitting egress of said pull tab from between said support and said reservoir.

46. A cartridge as claimed in claim 45 wherein said securement means includes an elastic member detachably coupled between hooks on opposing sides of said support, said elastic member extending over and engaging said cartridge.

* * * * *